US007740112B2

(12) United States Patent
Iwata et al.

(10) Patent No.: US 7,740,112 B2
(45) Date of Patent: Jun. 22, 2010

(54) ELEVATOR OPERATION CONTROL DEVICE FOR SELECTING AN OPERATION CONTROL PROFILE

(75) Inventors: Masafumi Iwata, Tokyo (JP); Takaharu Ueda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 547 days.

(21) Appl. No.: 11/575,270

(22) PCT Filed: Sep. 30, 2005

(86) PCT No.: PCT/JP2005/018156

§ 371 (c)(1),
(2), (4) Date: Mar. 14, 2007

(87) PCT Pub. No.: WO2007/039925

PCT Pub. Date: Apr. 12, 2007

(65) Prior Publication Data

US 2009/0045016 A1 Feb. 19, 2009

(51) Int. Cl.
*B66B 1/34* (2006.01)

(52) U.S. Cl. ..... 187/393; 187/295

(58) Field of Classification Search ..... 187/247, 187/380–388, 391–393, 277, 293–295
See application file for complete search history.

(56) References Cited

U.S. PATENT DOCUMENTS 3,891,064 A * 6/1975 Clark ..... 187/295
4,751,984 A * 6/1988 Williams et al. ..... 187/293
5,035,301 A * 7/1991 Skalski ..... 187/295
5,241,141 A * 8/1993 Cominelli ..... 187/295
5,266,757 A * 11/1993 Krapek et al. ..... 187/295
5,290,976 A * 3/1994 Bahjat et al. ..... 187/295
6,619,434 B1 * 9/2003 Peters et al. ..... 187/281

FOREIGN PATENT DOCUMENTS

| | | | |
|---|---|---|---|
| GB | 2245386 A | * | 1/1992 |
| JP | 57 62173 | | 4/1982 |
| JP | 3029883 | | 2/2000 |
| JP | 2002 3091 | | 1/2002 |
| JP | 3350439 | | 9/2002 |
| WO | 03 050028 | | 6/2003 |
| WO | 2005 030627 | | 4/2005 |
| WO | 2005 121002 | | 12/2005 |

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

In an elevator operation control device, a plurality of operation control profiles for prescribing values regarding operation of an elevator, for example, a speed of a car are registered in an operation control device body. The operation control device body collects values such as the activation frequency of the car and the like as information on a condition of use of the elevator. The operation control device body also selects one of the operation control profiles in accordance with the information on the condition of use, and controls the operation of the elevator based on the selected operation control profile.

18 Claims, 10 Drawing Sheets

FIG. 2

| HIGH SPEED-TYPE PROFILE | | | | | | |
|---|---|---|---|---|---|---|
| SPEED | ACCELERATION | JERK | DOOR-OPENING TIME | DOOR-OPENING SPEED | DOOR-CLOSING SPEED | POSSIBLE NUMBER OF CALLS TO BE ALLOCATED |
| v1 | a1 | j1 | tdo1 | vto1 | vtc1 | nc1 |

| MEDIUM-TYPE PROFILE | | | | | | |
|---|---|---|---|---|---|---|
| SPEED | ACCELERATION | JERK | DOOR-OPENING TIME | DOOR-OPENING SPEED | DOOR-CLOSING SPEED | POSSIBLE NUMBER OF CALLS TO BE ALLOCATED |
| v2 | a2 | j2 | tdo2 | vto2 | vtc2 | nc2 |

| RESTRAINT-TYPE PROFILE | | | | | | |
|---|---|---|---|---|---|---|
| SPEED | ACCELERATION | JERK | DOOR-OPENING TIME | DOOR-OPENING SPEED | DOOR-CLOSING SPEED | POSSIBLE NUMBER OF CALLS TO BE ALLOCATED |
| v3 | a3 | j3 | tdo3 | vto3 | vtc3 | nc3 |

FIG. 3

| SPEED PROFILE | | |
|---|---|---|
| HIGH SPEED TYPE | MEDIUM TYPE | RESTRAINT TYPE |
| v1 | v2 | v3 |

| ACCELERATION PROFILE | | |
|---|---|---|
| HIGH SPEED TYPE | MEDIUM TYPE | RESTRAINT TYPE |
| a1 | a2 | a3 |

| JERK PROFILE | | |
|---|---|---|
| HIGH SPEED TYPE | MEDIUM TYPE | RESTRAINT TYPE |
| j1 | j2 | j3 |

| DOOR-OPENING TIME PROFILE | | |
|---|---|---|
| HIGH SPEED TYPE | MEDIUM TYPE | RESTRAINT TYPE |
| tdo1 | tdo2 | tdo3 |

| DOOR-OPENING TIME PROFILE | | |
|---|---|---|
| HIGH SPEED TYPE | MEDIUM TYPE | RESTRAINT TYPE |
| vdo1 | vdo2 | vdo3 |

| DOOR-CLOSING SPEED PROFILE | | |
|---|---|---|
| HIGH SPEED TYPE | MEDIUM TYPE | RESTRAINT TYPE |
| vdc1 | vdc2 | vdc3 |

| PROFILE OF POSSIBLE NUMBER OF CALLS TO BE ALLOCATED | | |
|---|---|---|
| HIGH SPEED TYPE | MEDIUM TYPE | RESTRAINT TYPE |
| cn1 | cn2 | cn3 |

FIG. 7

| TIME | ACTIVATION FREQUENCY | NUMBER OF PASSENGERS | RUNNING DISTANCE |
|---|---|---|---|
| t | 10 TIMES | 5 PERSONS | 60m |
| t-1 | 7 TIMES | 4 PERSONS | 35m |
| ⋮ | ⋮ | ⋮ | ⋮ |
| t-N | 20 TIMES | 20 PERSONS | 80m |

FIG. 9

| TIME | ACTIVATION FREQUENCY | NUMBER OF PASSENGERS | RUNNING DISTANCE |
|---|---|---|---|
| 0:00—0:05 | 10 TIMES | 5 PERSONS | 60m |
| 0:05—0:10 | 7 TIMES | 4 PERSONS | 35m |
| ⋮ | ⋮ | ⋮ | ⋮ |
| 23:55—0:00 | 20 TIMES | 20 PERSONS | 80m |

ELEVATOR OPERATION CONTROL DEVICE FOR SELECTING AN OPERATION CONTROL PROFILE

TECHNICAL FIELD

The present invention relates to an elevator operation control device for controlling raising/lowering of a car of an elevator.

BACKGROUND ART

In a control device for a conventional elevator system, one of two operational profiles, namely, an operational profile with a reduced moving time between floors and an operational profile with an increased moving time between floors is selected in accordance with an average registration time (see, for example Patent Document 1).

Patent Document 1: JP 3029883 B

DISCLOSURE OF THE INVENTION

Problems To Be Solved By the Invention

In the conventional elevator system when an elevator is continuously operated for a long period of time for example, with loads applied to a car and a counterweight out of balance with each other, at a high acceleration/deceleration, or at high speed, drive components such as a hoisting machine, an inverter, a control circuit, and the like are affected by heat. For example, when the hoisting machine reaches high temperature, required performance cannot be achieved due to demagnetization. When the inverter and the control circuit reach high temperatures, there is a risk of components being damaged. Furthermore, in a case where a protection circuit for preventing the components from being damaged by heat is provided, the protection circuit operates to stop the elevator from operating As a result, an operation efficiency of the elevator declines.

The present invention has been made to solve the above-mentioned problems, and it is therefore an object of the present invention to obtain an elevator operation control device capable of restraining an elevator from being stopped from operating due to rises in temperatures of components and preventing the operation efficiency of the elevator from declining.

Means For Solving the Problems

An elevator operation control device according to the present invention includes: an operation control device body having registered therein a plurality of operation control profiles for prescribing values regarding operation of an elevator, for selecting one of the operation control profiles in accordance with information on a condition of use of the elevator and controlling the operation of the elevator based on the selected operation control profile.

BRIEF DESCRIPTION OF THE DRAWINGS

FIG. 2 is an explanatory diagram showing a first example of a registration format of operation control profiles in an elevator operation control device of FIG. 1.

FIG. 3 is an explanatory diagram showing a second example of a registration format of operation control profiles in the elevator operation control device of FIG. 1.

FIG. 7 is an explanatory diagram showing a recording format of information on conditions of use of an elevator operation control device according to Embodiment 2 of the present invention.

FIG. 9 is an explanatory diagram showing a recording format of information on conditions of use of an elevator operation control device according to Embodiment 3 of the present invention.

BEST MODES FOR CARRYING OUT THE INVENTION

Preferred embodiments of the present invention will be described hereinafter with reference to the drawings.

Embodiment 1

Figure 1:
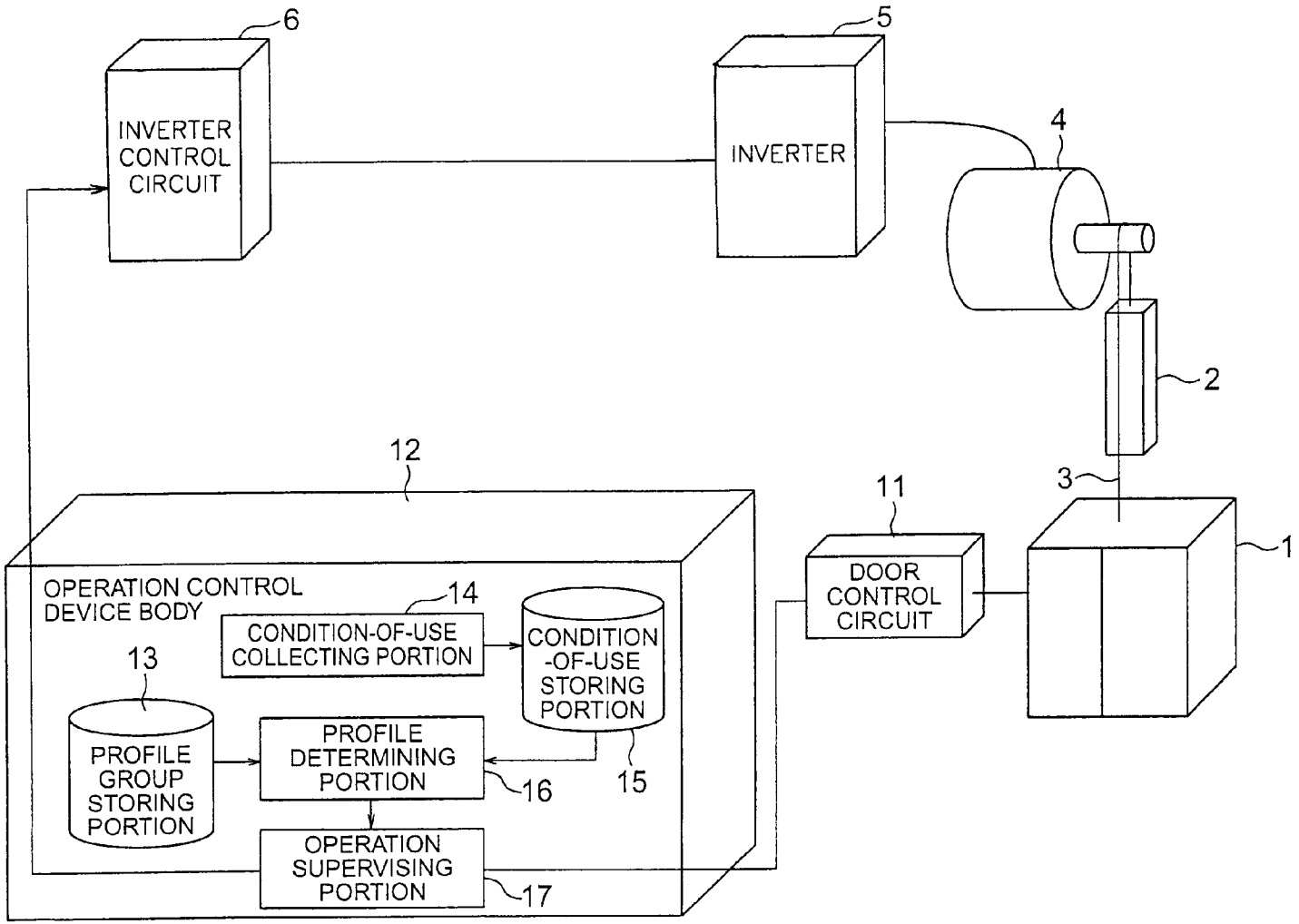
FIG. 1 is a schematic diagram showing an elevator apparatus according to Embodiment 1 of the present invention.

FIG. 1 is a schematic diagram showing an elevator apparatus according to Embodiment 1 of the present invention. Referring to the figure, a car 1 and a counterweight 2 which are suspended within a hoistway by means of a main rope 3, are raised/lowered within the hoistway due to a driving force of a hoisting machine 4. The hoisting machine 4 has a drive sheave around which the main rope 3 is looped, a motor for rotating the drive sheave, and a brake for braking rotation of the drive sheave.

A current supplied to the hoisting machine 4 is controlled by an inverter 5. The inverter 5 is controlled by an inverter control circuit 6. A drive device ford driving the car 1 and the counterweight 2 is composed of the main rope 3, the hoisting machine 4, the inverter 5, and the inverter control circuit 6.

The opening/closing of a car door and a landing door is controlled by door control circuit 11. The inverter control circuit 6 and the door control circuit 11 are controlled by an elevator operation control device. The elevator operation control device has an operation control device body 12.

The operation control device body 12 has a profile group storing portion 13, a condition-of-use collecting portion 14, a condition-of-use storing portion 15, a profile determining portion 16, and an operation supervising portion 17.

The profile group storing portion 13 has stored therein a plurality of operation control profiles for prescribing values regarding the operation of the elevator, for example, a speed of the car 1, an acceleration of the car 1, a jerk of the car 1, a door-opening time, a door-opening speed, a door-closing speed, a possible number of calls to be allocated, and the like.

The door-opening time represents a time it takes to make an automatic shift from a door-open state to a door-closed state without operating a door-closing button. The possible number of the calls to be allocated represents a constraint condition in allocating a plurality of cars 1 to landing calls when the cars 1 are subjected to operation control as a group. For example, when the number of landing calls and car calls registered in a certain one of the cars 1 is equal to or larger than the possible number of the calls to be allocated, another landing call generated at that moment is allocated to another one of the cars 1.

The operation control profiles are registered according to a format shown in, for example, FIG. 2 or FIG. 3. In an example of FIG. 2, three kinds of profiles (high speed-type profile, medium-type profile, and restraint-type profile) each composed of a combination of values in respective items are registered. In an example of FIG. 3, the high speed-type profile, the medium-type profile, and the restraint-type profile are individually set as to each of the items. It is appropriate that two or more operation control profiles be registered in the profile group storing portion 13 as to at least one of the items.

The condition-of-use collecting portion 14 collects values such as an activation frequency of the car 1, a running distance of the car 1, a number of passengers, a number of registered calls, and the like as information on a condition of use of the elevator. The condition-of-use storing portion 15 stores the information on the condition of use which has been collected by the condition-of-use collecting portion 14. The condition-of-use storing portion 15 also stores information on conditions of use of the past predetermined time (e.g., past five minutes). In a case where a plurality of types of information on the condition of use are stored, the time for storage may be changed according to the type.

The profile determining portion 16 selects and determines one of the operation control profiles in accordance with the information on the condition of use in such a manner as to prevent the elevator from being stopped from operating due to the operation of a protection circuit and to prevent components from being damaged. The operation supervising portion 17 performs the control of the hoisting machine 4 and the doors based on the operation control profile determined by the profile determining portion 16.

The operation control device body 12 is constituted by a computer having a calculation processing portion (CPU), a storage portion (ROM, RAM, hard disk, and the like), and a signal input/output portion. The functions of the profile group storing portion 13, the condition-of-use collecting portion 14, the condition-of-use storing portion 15, the profile determining portion 16, and the operation supervising portion 17 are realized by the computer constituting the operation control device body 12.

That is, control programs for realizing the functions of the profile group storing portion 13, the condition-of-use collecting portion 14, the condition-of-use storing portion 15, the profile determining portion 16, and the operation supervising portion 17 are stored in the storage portion of the computer. Data on the operation control profiles and the information on the condition of use are also stored in the storage portion. The calculation processing portion performs a calculation processing regarding the function of the operation control device body 12 based on a corresponding one of the control programs.

Figure 4:
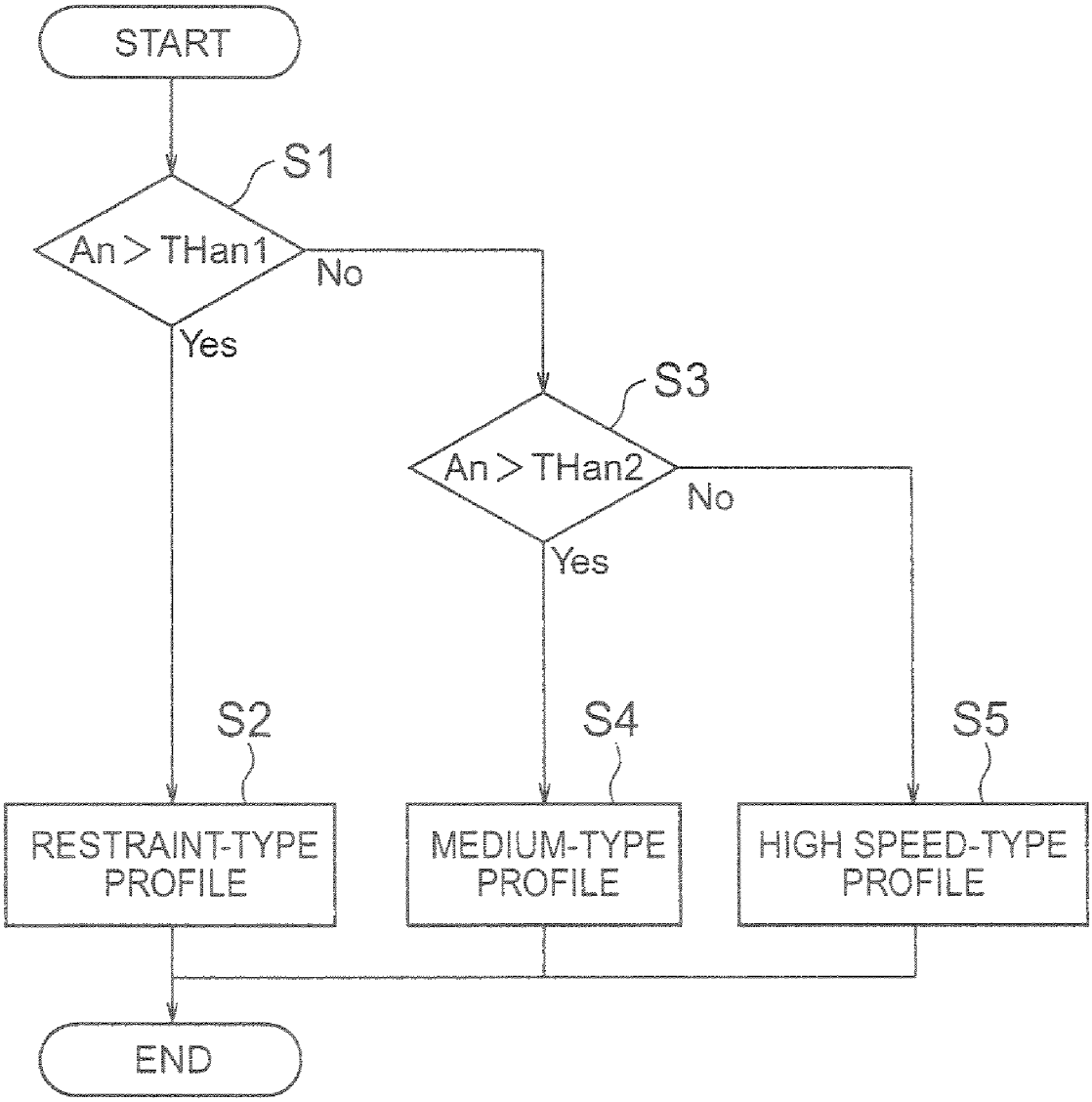
FIG. 4 is a flowchart showing an example of an operation of a profile determining portion of FIG. 1.

FIG. 4 is a flowchart showing an example of an operation of the profile determining portion 16 of FIG. 1. In FIG. 4, one of the profiles is determined based only on an activation frequency An, which constitutes part of the information on the condition of use. A first threshold THan1 and a second threshold THan2 (THan1>THan2) are set in the profile determining portion 16 as thresholds of the activation frequency.

In the profile determining portion 16, it is first determined whether or not the activation frequency An is higher than the first threshold THan1 (Step S1). When the activation frequency An is higher than the first threshold THan1, the restraint-type profile of FIG. 2 is selected so as to restrain the temperatures of the components from rising (Step S2).

When the activation frequency An is equal to or lower than the first threshold THan1, it is determined whether or not the activation frequency An is higher than the second threshold THan2 (Step S3) When the activation frequency An is higher than the second threshold THan2, the medium-type profile of FIG. 2 is selected (Step S4).

When the activation frequency An is equal to or lower than the second threshold THan2, it is determined that the loads applied to the components are small even when the elevator is caused to travel at high speed, so the high speed-type profile of FIG. 2 is selected (Step S5). In the profile determining portion 16, an operation as shown in FIG. 4 is performed in succession in a predetermined cycle, and the selected profile is updated in accordance with fluctuations in the activation frequency An.

Figure 5:
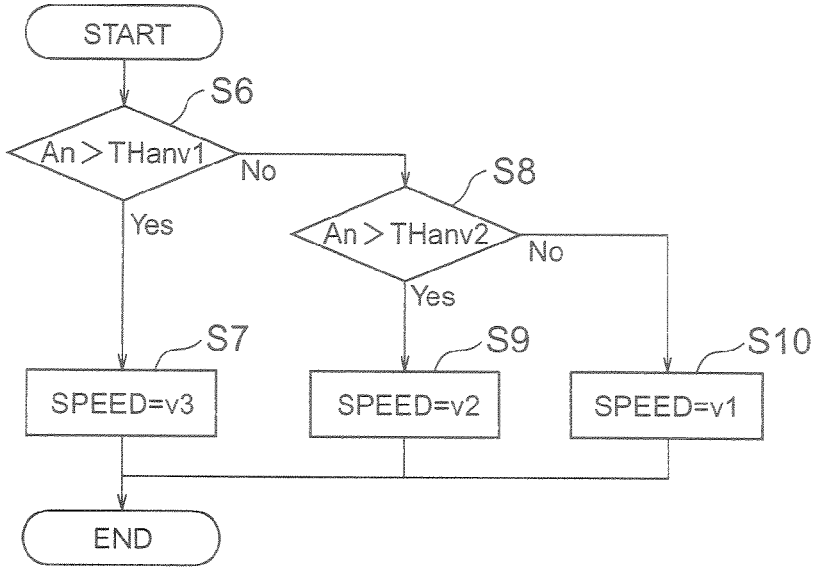
FIG. 5 is a flowchart showing a speed profile determining operation performed by the profile determining portion of FIG. 1

In a case where the plurality of the profiles are set as to each of the items as shown in FIG. 3, one of the profiles is selected and determined as to each of the items. For example, FIG. 5 is a flowchart showing a speed profile determining operation performed by the profile determining portion 16 of FIG. 1. In this case, a first threshold THanv1 and a second threshold THanv2 (THanv1>THanv2) are set in the profile determining portion 16 as thresholds of the activation frequency.

In the profile determining portion 16 it is first determined whether or not the activation frequency An is higher than the first threshold THanv1 (Step S6). When the activation frequency An is higher than the first threshold THanv1, a restraint-type speed profile of FIG. 3 is selected so as to restrain the temperatures of the components from rising (Step S7).

When the activation frequency An is equal to or lower than the first threshold THanv1, it is determined whether or not the activation frequency An is higher than the second threshold THanv2 (Step S8). When the activation frequency An is higher than the second threshold THanv2, a medium-type speed profile of FIG. 3 is selected (Step S9).

When the activation frequency An is equal to or lower than the second threshold THanv2, it is determined that the loads applied to the components are small even when the elevator is caused to travel at high speed, so a high speed-type speed profile (v1>v2>v3) of FIG. 3 is selected (Step S10). In the profile determining portion 16, an operation as shown in FIG. 5 is performed in succession in a predetermined cycle, and the selected speed profile is updated in accordance with fluctuations in the activation frequency An.

Figure 6:
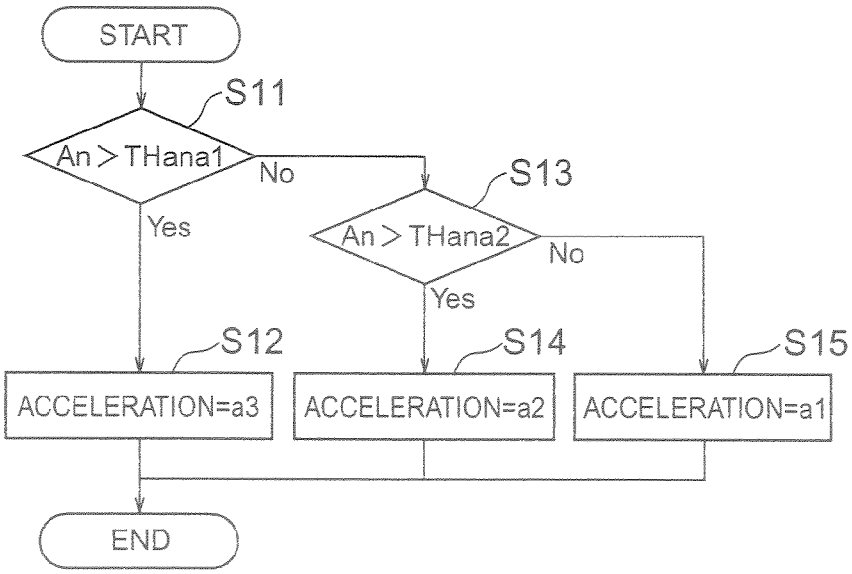
FIG. 6 is a flowchart showing an acceleration profile determining operation performed by the profile determining portion of FIG. 1.

FIG. 6 is a flowchart showing an acceleration profile determining operation performed by the profile determining portion 16 of FIG. 1. In this case, a first threshold THana1 and a second threshold THana2 (THana1>THana2) are set in the profile determining portion 16 as thresholds of the activation frequency.

In the profile determining portion 16, it is first determined whether or not the activation frequency An is higher than the first threshold THana1 (Step S11). When the activation frequency An is higher than the first threshold THana1, a restraint-type acceleration profile of FIG. 3 is selected so as to restrain the temperatures of the components from rising (step S12).

When the activation frequency An is equal to or lower than the first threshold THana1, it is determined whether or not the activation frequency An is higher than the second threshold THana2 (Step S13). When the activation frequency An is higher than the second threshold THana2, a medium-type acceleration profile of FIG. 3 is selected (Step S14).

When the activation frequency An is equal to or lower than the second threshold THana2, it is determined that the loads applied to the components are small even when the elevator is caused to travel at high speed, so a high speed-type acceleration profile (a1>a2>a3) of FIG. 3 is selected (Step S15). In the profile determining portion 16, the operation as shown in FIG. 5 is performed in succession in a predetermined cycle, and the selected acceleration profile is updated in accordance with fluctuations in the activation frequency An.

One of the operation control profiles in the other items, namely, the jerk, the door-opening time, the door-opening speed, the door-closing speed, and the possible number of calls to be allocated can also be determined according to the same method as in the cases of the speed and the acceleration.

The operation control device body 12 structured as described above selects one of the operation control profiles in accordance with the information on the condition of use of the elevator, and controls the operation of the elevator based on the selected operation control profile. Therefore, the elevator can be restrained from being stopped from operating due to rises in the temperatures of the components so the operation efficiency of the elevator can be prevented from declining.

Embodiment 2

Next, Embodiment 2 of the present invention will be described. In Embodiment 2 of the present invention pieces of information on conditions of use in a plurality of time zones are cumulatively stored in the condition-of-use storing portion 15. For example, FIG. 7 is an explanatory diagram showing a recording format of the information on the conditions of use of an elevator operation control device according to Embodiment 2 of the present invention. In this example, values of an activation frequency, the number of passengers and a running distance are recorded in a time-series manner at intervals of, for example, five minutes. The number of the pieces of the information on the conditions of use in the past to be accumulated from which a piece of information corresponding to the latest time zone is excluded, is N.

Figure 8:
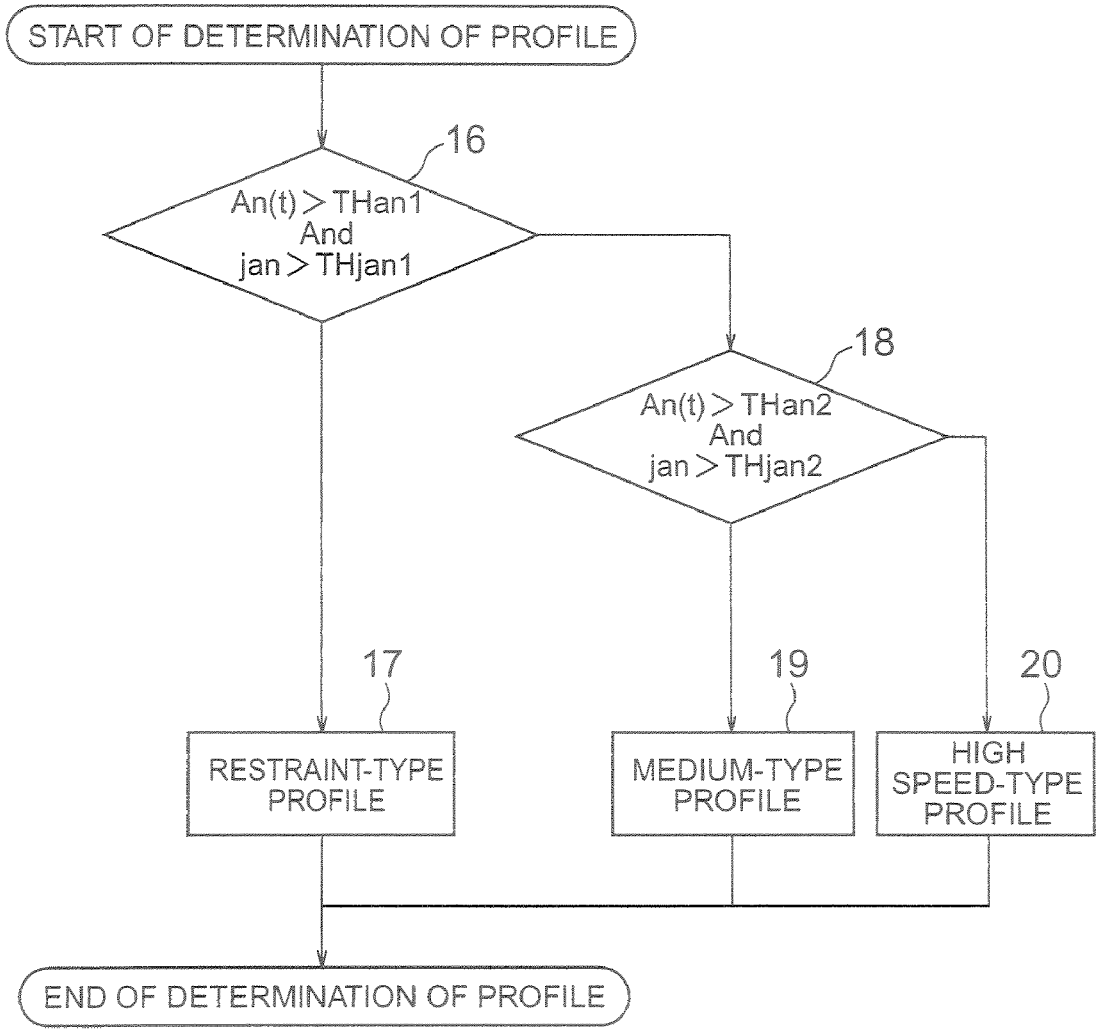
FIG. 8 is a flowchart showing an example of a profile determining operation of the elevator operation control device according to Embodiment 2 of the present invention.

The profile determining portion 16 calculates a transition condition of the conditions of use from the information stored in the condition-of-use storing portion 15, and selects one of the operation control profiles based on the calculated transition condition. FIG. 8 is a flowchart showing an example of a profile determining operation of the elevator operation control device according to Embodiment 2 of the present invention.

In this example, a value $An(\tau)$ representing a condition of use at an arbitrary time $\tau$ and a value $An(\tau-1)$ representing a condition of use at a time $\tau-1$ are compared with each other, and a number jan of times of increases corresponding to an expression of $An(\tau)>An(\tau-1)$ is counted. One of the profiles is selected based on jan, or jan and a value $An(t)$ representing the latest condition of use. In other words, as the value of jan increases, the profile determining portion 16 becomes more likely to determine that the frequency of use of the elevator has increased, and to restrain the elevator from operating.

To be more specific the values THan1 and THan2 (THan1>THan2) as the thresholds of the activation frequency and values THjan1 and THjan2 (THjan1>THjan2) as thresholds of the number jan of times of increases are set in the profile determining portion 16.

In the profile determining portion 16, it is first determined whether or not the activation frequency An is higher than the threshold THan1 and whether or not the number jan of times of increases is larger than the threshold THjan1 (Step S1). When the activation frequency An is higher than the threshold THan1 and the number jan of times of increases is larger than the threshold THjan1, the restraint-type profile of FIG. 2 is selected so as to restrain the temperatures of the components from rising (Step S17).

When the activation frequency An is equal to or lower than the threshold THan1 or when the number jan of times of increases is equal to or smaller than the threshold THjan1, it is determined whether or not the activation frequency An is higher than the threshold THan2 and whether or not the number jan of times of increases is larger than the threshold THjan2 (Step S18). When the activation frequency An is higher than the threshold THan2 and the number jan of times of increases is larger than the threshold THjan2, the medium-type profile of FIG. 2 is selected (Step S19).

When the activation frequency An is equal to or lower than the threshold THan2 or when the number jan of times of increases is equal to or smaller than the threshold THjan2, it is determined that the loads applied to the components is small even when the elevator is caused to travel at high speeds so the high speed-type profile of FIG. 2 is selected (Step S5). In the profile determining portion l6, an operation as shown in FIG. 8 is performed in succession an a predetermined cycles and the selected profile is updated in accordance with fluctuations in the activation frequency An and the number jan of times of increases. Embodiment 2 of the present invention is identical to Embodiment 1 of the present invention in other constructional details.

In the elevator operation control device structured as described above, the transition condition of the conditions of use is calculated from the information on the conditions of use, and one of the operation control profiles is selected based on the calculated transition condition. Therefore the elevator can be more reliably restrained from being stopped from operating due to rises in the temperatures of the components, so the operation efficiency of the elevator can be prevented from declining.

Embodiment 3

Next, Embodiment 3 of the present invention will be described. In Embodiment 3 of the present invention, average values of pieces of information on conditions of use from a preceding day to a current day, which corresponds to one day, are recorded in the condition-of-use storing portion 15 for each of time zones. For example, FIG. 9 is an explanatory diagram showing a recording format of information on conditions of use of an elevator operation control device according to Embodiment 3 of the present invention. In this example, average values of the activation frequency, the number of passengers, and the running distance, which date back from the preceding day, are recorded in a time-series manner at intervals of, for example, five minutes. The average values of the information on the conditions of use are sequentially updated by adding values of a current day thereto, respectively.

The profile determining portion 15 takes out values of a condition of use in a subsequent time zone from the information stored in the condition-of-use storing portion 15, and selects one of the operation control profiles according to, for example, a method as shown in FIG. 4. It is also appropriate to calculate a transition condition from values of N conditions from the past to the future including a condition of use at the present moment, and select one of the operation control profiles according to a method as shown in FIG. 7.

It is also appropriate to store both the average values of the conditions of use from the preceding day as shown in FIG. 9 and the N values in the past corresponding to the current day as shown in FIG. 7 into the condition-of-use storing portion 15, and select one of the operation control profiles by using both the values. That is, it is also appropriate to calculate the number jan of times of increases as to each of the N values in the past as shown in FIG. 7 and each of M values corresponding to a period preceded by the present moment as shown in FIG. 9, and select one of the operation control profiles according to a method shown in FIG. 8. Embodiment 3 of the present invention is identical to Embodiment of the present invention in other constructional details.

In the elevator operation control device configured as described above, the average value of the information on the conditions of use from the preceding day is recorded for each of the time zones, and one of the operation control profiles is selected based on the average value of the information on the conditions of use. Therefore, the elevator can be more reliably restrained from being stopped from operating due to rises in the temperatures of the components, so the operation efficiency of the elevator can be prevented from declining.

Embodiment 4

Figure 10:
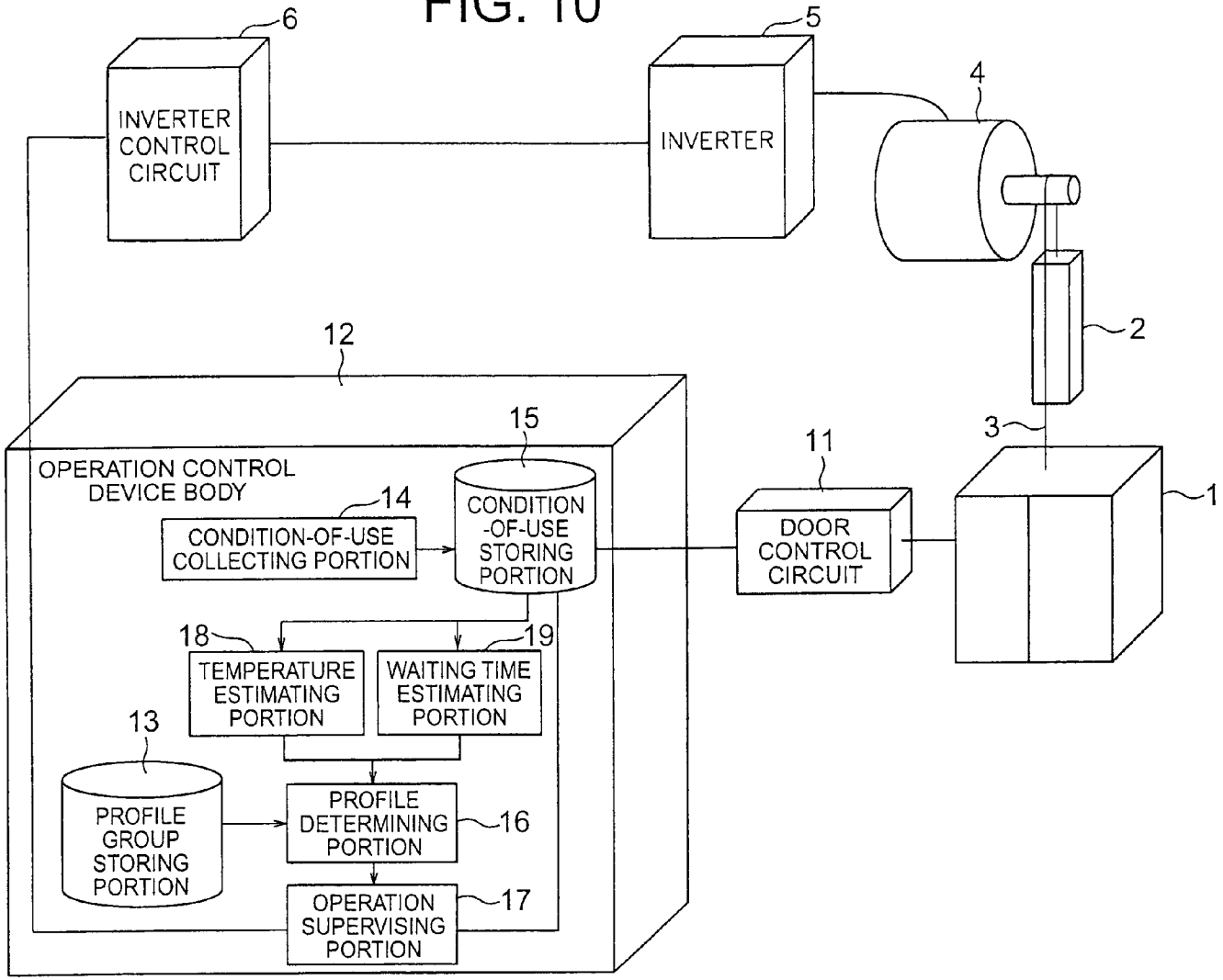
FIG. 10 is a schematic diagram showing an elevator apparatus according to Embodiment 4 of the present invention.

Reference is made next to FIG. 10, which is a schematic diagram showing an elevator apparatus according to Embodiment 4 of the present invention. Referring to the figure, the operation control device body 12 has functions of a temperature estimating portion 18 and a waiting time estimating portion 9 in addition to the functions of Embodiment 1 of the present invention. The functions of the temperature estimating portion 18 and the waiting time estimating portion 19 are also realized by the computer constituting the operation control device body 12.

The temperature estimating portion 18 estimates a future temperature of the drive device by using the information on the future condition of use in Embodiment 3 of the present invention (FIG. 4). The waiting time estimating portion 19 estimates a future waiting time using the information on the future condition of use in Embodiment 3 of the present invention (FIG. 4). The profile determining portion 16 determines a current one of the operation control profiles which is required in order to minimize the waiting time while holding the temperature of the drive device equal to or lower than an allowable value.

To be more specific, the temperature estimating portion 18 estimates a temperature of the drive device at a future time point t+L from the values of the conditions of use at K time points including the present moment (L<K). The future temperature of the drive device can be calculated through, for example, a simulation carried out in a case where a certain one of the operation control profiles has been determined. Such the simulation is carried out as to all profile groups. An estimated value of the temperature of he drive device is denoted by a symbol T(t+L).

The waiting time estimating portion 19 estimates a waiting time at the future time point t+L from the values of the conditions of use corresponding to the K time points including the present moment. The future waiting time can be calculated through, for example, a simulation carried out in the case where a certain one of the operation control profiles has been determined. Such the simulation is carried out as to all the profile groups. An estimated value of the waiting time is denoted by a symbol AWT(t+L).

The profile determining portion 16 selects that one of the operation control profiles in which the estimated value T(t+L) of the temperature of the drive device is below a threshold THt and the estimated value AWT(t+L) of the waiting time is minimized.

In the elevator operation control device structured as described above, the future temperature of the drive device and the future waiting time are estimated from the information on the conditions of use, and one of the operation control profiles is selected such that the temperature of the drive device becomes equal to or lower than the allowable value and that the waiting time is minimized. Therefore the operation efficiency of the elevator can be enhanced while more reliably restraining the elevator from being stopped from operating due to rises in the temperatures of the components.

Embodiment 5

Figure 11:
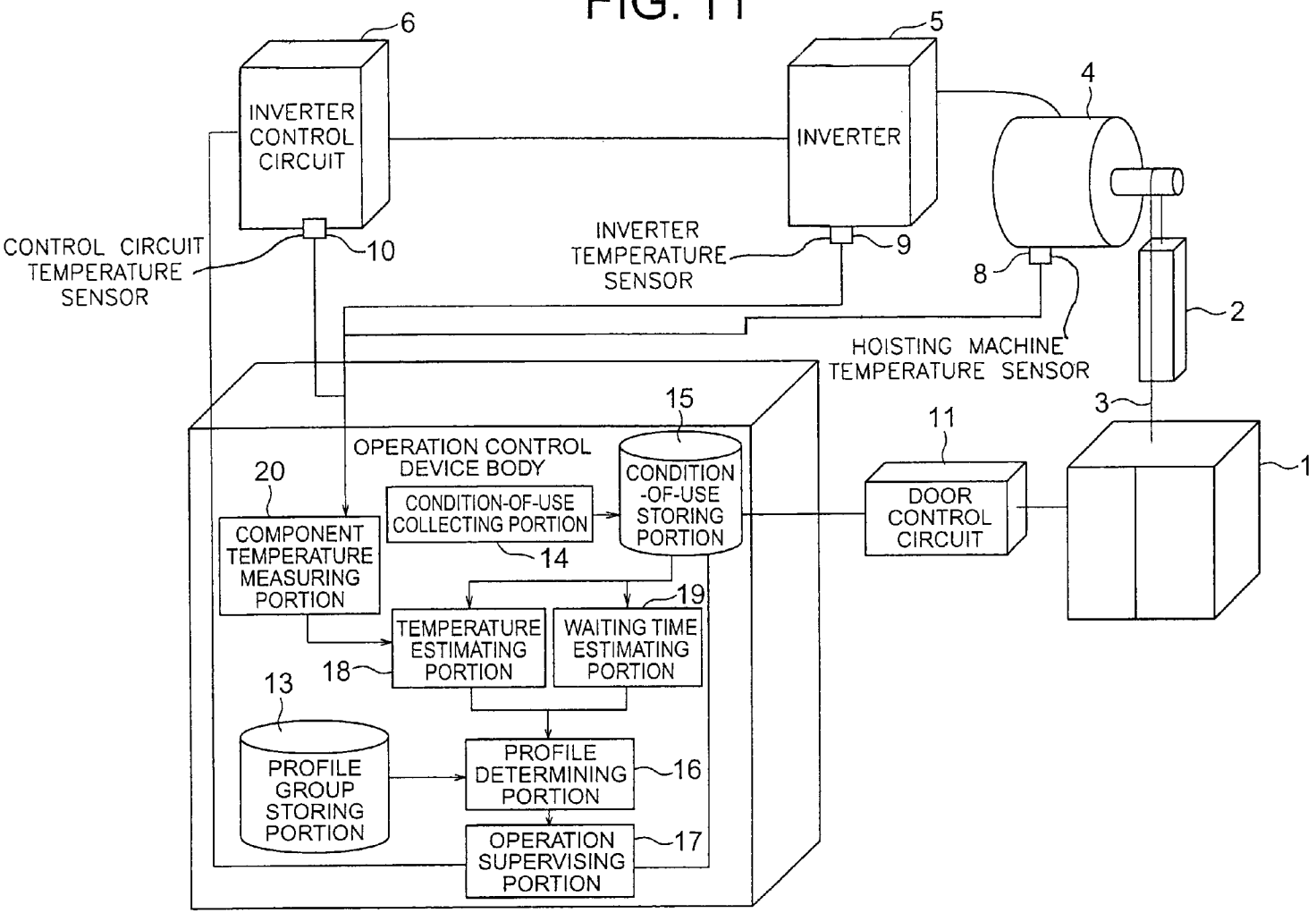
FIG. 11 is a schematic diagram showing an elevator apparatus according to Embodiment 5 of the present invention.

Reference is made next to FIG. 11, which is a schematic diagram showing an elevator apparatus according to Embodiment 5 of the present invention. Referring to the figure, the hoisting machine 4 is provided with a hoisting machine temperature sensor 8 for outputting a signal corresponding to a temperature of the hoisting machine 4. The inverter 5 is provided with an inverter temperature sensor 9 for outputting a signal corresponding to a temperature of the inverter 5. The inverter control circuit 6 is provided with a control circuit temperature sensor 10 for outputting a signal corresponding to a temperature of the inverter control circuit 6.

The operation control device body 12 is provided with a component temperature measuring portion 20. The component temperature measuring portion 20 measures temperatures of the hoisting machine 4, the inverter 5, and the inverter control circuit 6, which constitute the drive device, based on signals from the temperature sensors 8 to 10, respectively. The function of the component temperature measuring portion 20 is also realized by the computer constituting the operation control device body 12.

The temperature estimating portion 18 estimates a future temperature of the drive device by using the temperature of the drive device, which has been measured by the component temperature measuring portion 20, and the information on the future conditions of use in Embodiment 3 of the present invention (FIG. 4). To be more specific, the temperature estimating portion 18 estimates a temperature of the drive device at the future time point t+L from the values of the conditions of use corresponding to the K time points including the present moment, a current temperature Tm of the hoisting machine 4, a current temperature Ti of the inverter 5, and a current temperature Tc of the inverter control circuit 6(L<K). The future temperature of the drive device can be calculated through for example, a simulation carried out in the case where a certain one of the operation control profiles has been determined. Such the simulation is carried out as to all the profile groups. Embodiment 5 of the present invention is identical to Embodiment 4 of the present invention in other operational details.

In the elevator operation control device configured as described above the future temperature of the drive device is estimated by using the measured value of the current temperature of the drive device as well as the information on the future conditions of use. Therefore, the temperature of the drive device can be more accurately estimated. As a result the elevator can be more reliably restrained from being stopped from operating due to rises in the temperatures of the components.

In Embodiment 5 of the present invention, the temperatures of the hoisting machine 4, the inverter 5, and the inverter control circuit 6 are measured to obtain the temperature of the drive device. However, it is also appropriate to measure a temperature of another portion, for example, a temperature of the main rope 3.

The invention claimed is:

1. An elevator operation control device, comprising:

an operation control device body having registered therein a plurality of operation control profiles for prescribing values regarding operation of an elevator, configured to estimate a future temperature of a drive device that drives a car of the elevator, select one of the operation control profiles in accordance with information on a condition of use of the elevator and the estimated future temperature, and control the operation of the elevator based on the selected operation control profile.

2. The elevator operation control device according to claim 1, wherein the operation control profiles each include at least one of items composed of a speed of a car, an acceleration of the car, a jerk of the car, a door-opening time, a door-opening speed, and a door-closing speed, and the plurality of operation control profiles are registered as to each of the items.

3. The elevator operation control device according to claim 1, wherein the operation control device body collects at least one value of an activation frequency of the car, a running distance of the car, a number of passengers, and a number of registrations of calls as the information on the condition of use.

4. The elevator operation control device according to claim 1, wherein the operation control device body stores information on conditions of use of a past predetermined time.

5. The elevator operation control device according to claim 1, wherein the operation control device body calculates a transition condition of the condition of use from the information on the condition of use, and selects one of the operation control profiles based on the calculated transition condition.

6. The elevator operation control device according to claim 1, wherein the operation control device body selects one of the operation control profiles based on an average value of information on conditions of use from a preceding day for each of time zones.

7. The elevator operation control device according to claim 1, wherein the operation control device body estimates a future waiting time from the information on the condition of use, and selects one of the operation control profiles such that the temperature of the drive device becomes equal to or lower than an allowable value and that the waiting time is minimized.

8. The elevator operation control device according to claim 7, wherein the operation control device body estimates the future temperature of the drive device from the information on the condition of use and a measured value of a current temperature of the drive device.

9. An elevator operation control device, comprising:

an operation control device body having registered therein a plurality of operation control profiles for prescribing values regarding operation of an elevator, for selecting one of the operation control profiles in accordance with information on a condition of use of the elevator and controlling the operation of the elevator based on the selected operation control profile, wherein the operation control device body estimates a future temperature of a drive device for driving the car and a future waiting time from the information on the condition of use, and selects one of the operation control profiles such that the temperature of the drive device becomes equal to or lower than an allowable value and that the waiting time is minimized.

10. The elevator operation control device according to claim 9, wherein the operation control device body estimates the future temperature of the drive device from the information on the condition of use and a measured value of a current temperature of the drive device.

11. A method of controlling an elevator using an elevator operation control device, the method comprising:

registering a plurality of operation control profiles for prescribing values regarding operation of the elevator;

estimating a future temperature of a drive device that drives a car of the elevator;

selecting one of the operation control profiles based on the estimated future temperature and a condition of use of the elevator; and controlling the operation of the elevator based on the selected operation control profile.

12. The method according to claim 11, wherein the operation control profiles each include at least one of items composed of a speed of a car, an acceleration of the car, a jerk of the car, a door-opening time, a door-opening speed, and a door-closing speed, and the plurality of operation control profiles are registered as to each of the items.

13. The method according to claim 11, further comprising:

collecting at least one value of an activation frequency of the car, a running distance of the car, a number of passengers, and a number of registrations of calls as the information on the condition of use.

14. The method according to claim 11, further comprising:

storing information on conditions of use of a past predetermined time.

15. The method according to claim 11, further comprising:

calculating a transition condition of the condition of use from the information on the condition of use; and selecting one of the operation control profiles based on the transition condition from the calculating.

16. The method according to claim 11, further comprising:

selecting one of the operation control profiles based on an average value of information on conditions of use from a preceding day for each of time zones.

17. The method according to claim 11, further comprising:

estimating a future waiting time from the information on the condition of use; and selecting one of the operation control profiles such that the temperature of the drive device becomes equal to or lower than an allowable value and that the waiting time is minimized.

18. The method according to claim 11, further comprising:

estimating the future temperature of the drive device from the information on the condition of use and a measured value of a current temperature of the drive device.

* * * * *